US007198517B2

(12) United States Patent
Kuo

(10) Patent No.: US 7,198,517 B2
(45) Date of Patent: Apr. 3, 2007

(54) ELECTRONIC CARD CONNECTOR

(75) Inventor: Ming-Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 121 days.

(21) Appl. No.: 10/982,281

(22) Filed: Nov. 5, 2004

(65) Prior Publication Data

US 2005/0106915 A1 May 19, 2005

(30) Foreign Application Priority Data

Nov. 18, 2003 (TW) ..... 92220365 U

(51) Int. Cl.
*H01R 13/648* (2006.01)

(52) U.S. Cl. ..... 439/607; 439/630

(58) Field of Classification Search ..... 439/159, 439/607, 609, 630, 680
See application file for complete search history.

(56) References Cited

U.S. PATENT DOCUMENTS 6,120,322 A 9/2000 Ho et al.
6,247,968 B1 * 6/2001 Wu ..... 439/607
6,368,123 B2 4/2002 Uchiyama et al.
6,433,825 B1 8/2002 Cama et al.
6,478,630 B1 * 11/2002 Hsu ..... 439/680

* cited by examiner

*Primary Examiner*—Khiem Nguyen
(74) *Attorney, Agent, or Firm*—Wei Te Chung

(57) ABSTRACT

An electronic card connector (100) comprises an insulating housing (10), a plurality of contacts (20) received in the insulating housing (10), and a shell (30) mounted on the insulating housing (10). The shell (30) comprises a top plate portion (320), a pair of side plate portions (322) and a pair of bottom plate portions (324). A plurality of spring arms (321, 325) is stamped from the top plate portion (320) and the bottom plate portions (324). The spring arms (321) stamped from the top plate portion (320) and the spring arms (325) stamped from the bottom plate portions (324) define a pair of guide recesses (34) to guide an electronic card into the insulating housing (10). All the spring arms (321, 325) can mechanically and electrically connect with the inserted electronic card reliably and perform ESD function.

10 Claims, 3 Drawing Sheets

ELECTRONIC CARD CONNECTOR

1. Field of the Invention

The present invention generally relates to an electronic card connector, and more particularly to an electronic card connector used in notebook computer for receiving an electronic card.

2. Description of Related Art

U.S. Pat. No. 6,120,322 discloses a card connector including an insulating housing, a plurality of contacts received in the housing and a shell. The insulating housing has a rear connector section for connecting with a card. A pair of guide racks extends forwardly from two lateral ends of the rear connector section for facilitating the insertion of the card into the rear connector section. The guide racks and the connector section define a space sufficient for accommodating the memory card. A pair of guide recesses is defined in the inner face of the guide racks for holding the memory card in its position to insure a good connection between the memory card and the rear connector section. The shell is positioned on and fixed to the insulating housing and covers the space defined by the rear connector section and the guide racks. Moreover, the shell has a pair of sidewalls fixed to the guide racks so that the shell can be mounted onto the connector firmly.

However, the pair of guide racks and the guide recesses therein not only complicate the manufacturing process but also add the manufacturing cost of the card connector. In addition, the pair of guide racks increases the width of the card connector, which is not desirable from the standpoint of the compactness.

Hence, an improved PC card connector is desired to overcome the disadvantages of the prior art.

SUMMARY OF THE INVENTION

Accordingly, an object of the present invention is to provide a low cost electronic card connector with simple manufacture process and compact structure arrangement.

In order to achieve the object set forth, an electronic card connector in accordance with the present invention comprises an insulating housing with a mating portion, a plurality of contacts received in the insulating housing, and a shell mounted on the insulating housing. The shell comprises a top plate portion, a pair of side plate portions extending vertically from opposite sides of the top plate portion and a pair of bottom plate portions extending toward each other from the lower ends of the side plate portions. The top plate portion, the side plate portions, and the bottom plate portions define a card receiving space for accommodating an electronic card. The top plate portion integrally forms a row of first spring arms which is bowed inwardly in a longitudinal direction thereof. Moreover, each of the bottom plate portions forms a row of second spring arms opposite to the first spring arms in a longitudinal direction thereof. The first spring arms and the second spring arms define a pair of guide recesses to guide the electronic card into the insulating housing. All the spring arms can mechanically and electrically connect with the electronic card reliably, and perform electrostatic discharge (ESD) function.

Other objects, advantages and novel features of the invention will become more apparent from the following detailed description of the present embodiment when take in conjunction with the accompany drawings.

DETAILED DESCRIPTION OF PREFERRED EMBODIMENTS

Figure 1:
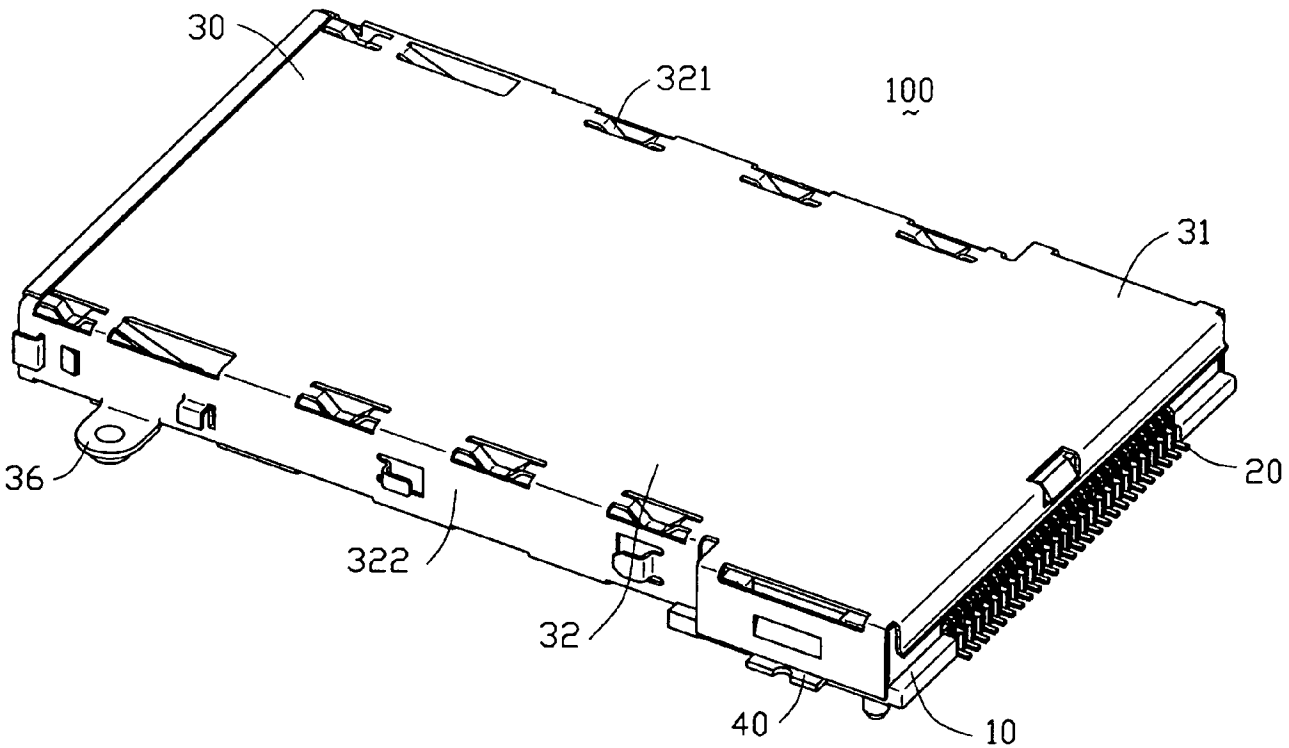
FIG. 1 is a perspective view of an electronic card connector in accordance with the present invention.

Referring to FIG. 1, an electronic card connector 100 in accordance with the present invention includes an insulating housing 10, a plurality of contacts 20 received in the insulating housing, a shell 30 mounted on the insulating housing, and a connecting member 40.

Figure 2:
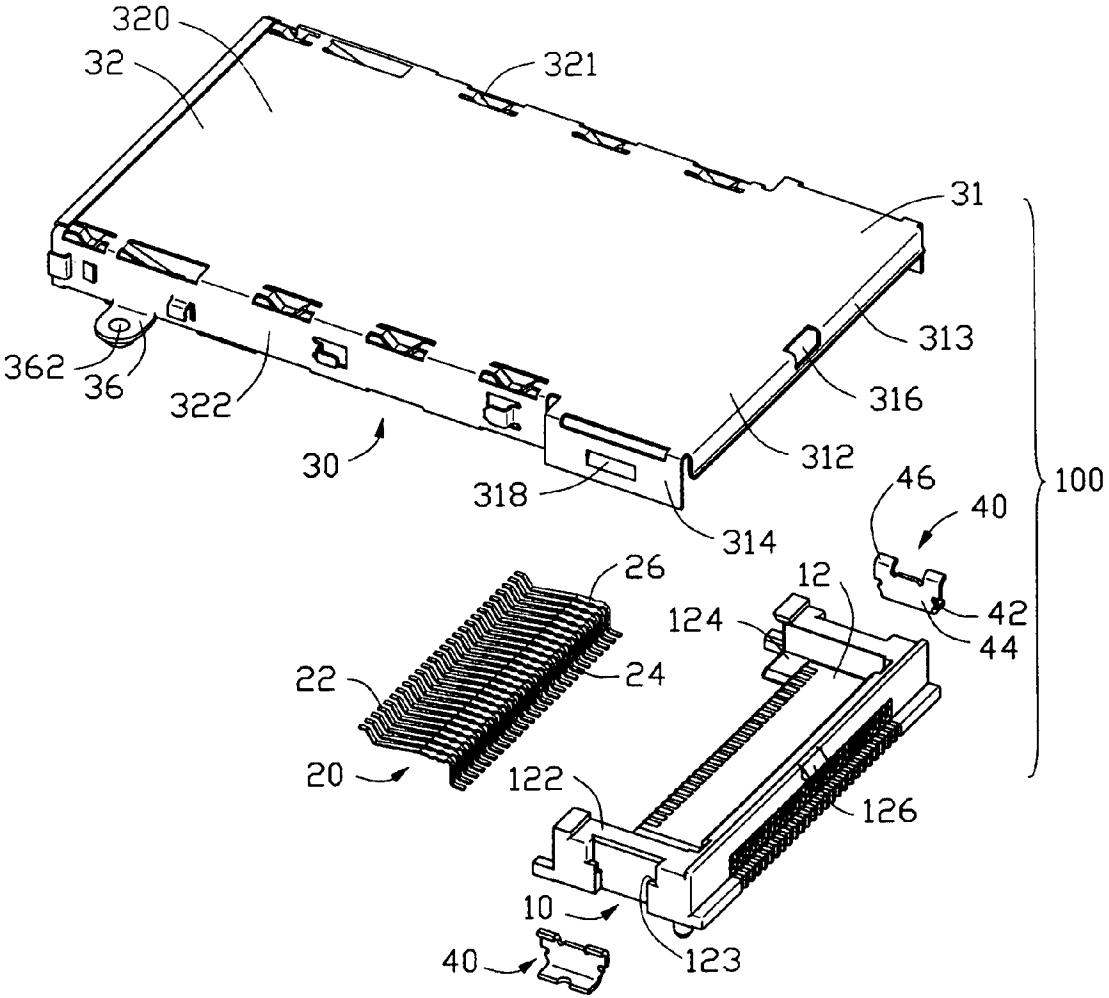
FIG. 2 is an exploded, perspective view of the electronic card connector shown in FIG. 1.

As shown in FIG. 2, the insulating housing 10 comprises a substantially rectangular mating portion 12 which extends in the longitudinal direction, a pair of side arms 122 parallelly extending rearwardly from two sides of the mating portion 12, and a bottom portion 124 connecting with the pair of side arms 122. A holding barb 126 protrudes from the front end of the mating portion. On the outer face of the side arms 122, a pair of retaining recesses 123 is defined. The holding barb 126 lies above the contacts 20 and is in the center of the mating portion in the longitudinal direction. The connecting member 40 comprises mounting portion 42, a pair of hooks 46, and a coupling portion 44 coupling the mounting portion 42 and the hooks 46.

The contacts 30 are received in the mating portion 12 of the insulating housing 10. Each of the contacts 30 includes a contacting portion 22 electrically connecting with an electronic card (not shown) inserted into the insulating housing, a soldering portion 24 for electrically connecting with a printed circuit board (not shown) and a retaining portion 26 connecting with the contacting portion 22 and the soldering portion 24. The retaining portion 26 is retained in the mating portion. The contacting portion 22 and the soldering portion 24 both are outside the mating portion 12.

Figure 3:
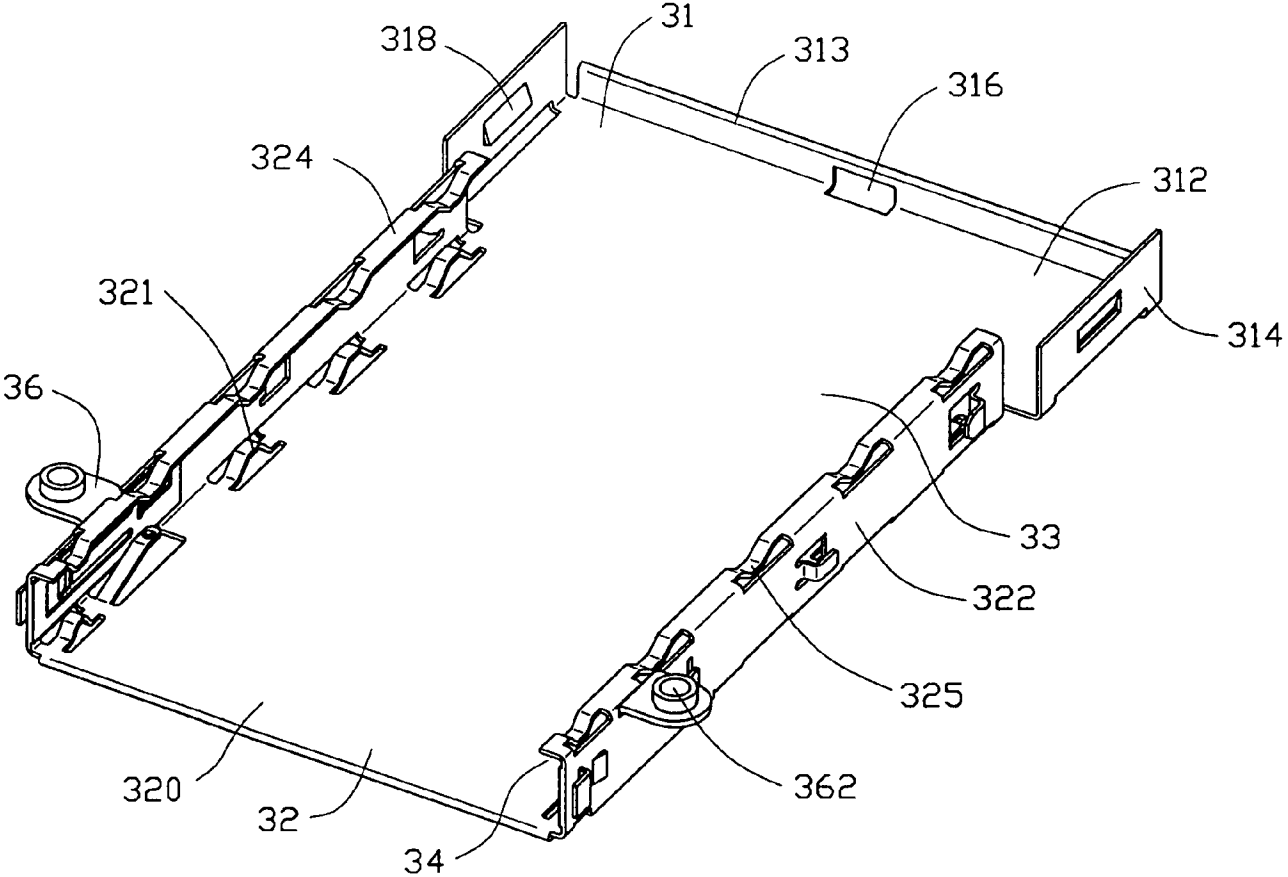
FIG. 3 is a perspective view of a shell of the electronic card connector in accordance with the present invention.

Referring to FIGS. 1–3, the shell 30 comprises a front portion 31 and a rear portion 32. The front portion 31 comprises a rectangular base 312, a pair of sidewalls 314 depending from the opposite edges of the base 312 and a stopper 313 extending vertically and downwardly from the front edge of the base 312. In the joint of the stopper 313 and the base 312, a notch 316 is defined. Additionally, in the sidewalls 314, a pair of elongated bars 318 is defined.

Turning to FIG. 3, the rear portion 32 comprises a top plate portion 320, a pair of side plate portions 322 extending vertically from opposite sides of the top plate portion 320 and a pair of bottom plate portions 324 extending toward each other from the lower ends of the side plate portions 322. The top plate portion 320, the side plate portions 322 and the bottom plate portions 324 together define a card receiving space 33 for accommodating the electronic card. Further, A fixing portion 36 protrudes from the rear end of the side plate portion 322 with a hole 362 with a hole 362 therethrough. The top plate portion 320 integrally forms a row of first spring arms 321 which is bowed inwardly in a longitudinal direction thereof. Moreover, each of the bottom plate portions 324 forms a row of second spring arms 325 in longitudinal direction opposite to the first spring arms 321. The row of first spring arms 321 and the row of second spring arms 325 are both spaced equidistantly. The first spring arms 321 and the second spring arms 325 define a pair of guide recesses 34 therebetween to guide the electronic card into the insulating housing 10. As all the spring arms 321, 325 are bowed inwardly, they all can mechanically and electrically connect with the electronic card reliably, and perform ESD function.

Turning to FIG. 1, the coupling portion 44 of the connecting member 40 is retained in the retaining recess 123 on the outer face of the side arm 122 of the insulating housing. When the shell 30 is mounted on the insulating housing 10, the hooks 46 of the connecting member 40 engage with the elongated bars 318 defined in the sidewalls 314. The holding barb 126 clips the notch 316 defined in the joint of the base 312 and the stopper 313. Thus, the shell 30 is fixed to the insulating housing 10 firmly. In addition, the guide recesses 34 are defined between the first spring arms 321 and the second spring arms 325 of the shell 30. These arrangements not only make the manufacture process simple, material saved, but also make the electronic connector structure comparably compact. In other words, the cost is reduced greatly and the space in the notebook computers is made good use of. It is well known that all these advantages above-mentioned are very desirable in the computer industry field.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector, comprising:

an insulating housing comprising a substantially rectangular mating portion extending in a longitudinal direction;

a plurality of contacts received in the mating portion of the insulating housing; and a shell mounted on the insulating housing and comprising a top plate portion, a pair of side plate portions extending vertically from opposite sides of the top plate portion, a pair of bottom plate portions extending toward each other from lower ends of the side plate portions, a card receiving space defined by the top plate portion, the side plate portions and the bottom plate portions, and a plurality of spring arms formed on each of the top plate portion and the bottom plate portions, the spring arms bowed into the card receiving space and defining a pair of guiding recesses between the spring arms formed on the top plate portion and on the bottom plate portions.

2. The card connector as described in claim 1, wherein the spring arms of the top plate portion and the bottom plate portions are all spaced equidistantly along a longitudinal direction of the shell.

3. The card connector as described in claim 1, wherein a fixing portion protrudes from a rear end of the side plate portion of the shell, and wherein a hole is defined in the fixing portion.

4. The card connector as described in claim 1, further comprising a pair of connecting members for fixing the shell to the insulating housing.

5. The card connector as described in claim 4, wherein the connecting member comprises a mounting portion, a coupling portion and a pair of hooks.

6. The card connector as described in claim 5, wherein the shell includes a front portion and a rear portion, the front portion comprising a rectangular base, a pair of sidewalls depending from the opposite edges of the base, a stopper extending vertically and downwardly from a front edge of the base, and a notch defined in a the joint of the stopper and the base, and wherein a pair of elongated bars is defined in the sidewalls for engaging with the hooks of the connecting member.

7. The card connector as described in claim 6, wherein the insulating housing comprises a pair of side arms parallelly extending along two sides of the mating portion, and wherein a holding barb protrudes from a front end of the mating portion to clip the notch of the shell.

8. The card connector as described in claim 7, wherein a retaining recess is defined on an outer face of the side arms for retaining the connecting member.

9. A card connector, comprising:

an insulating housing comprising a substantially rectangular mating portion extending in a longitudinal direction;

a plurality of contacts received in the mating portion of the insulating housing; and a metallic shell, of which the insulating housing is mounted to a rear end, comprising a horizontal plate portion, a pair of side plate portions extending vertically from opposite lateral sides of the top plate portion, a pair of flange-like plate portions extending toward each other from lower ends of the side plate portions, a card receiving space defined by the horizontal plate portion, the side plate portions and the flange-like plate portions, and a plurality of tabs formed on lateral side areas of the horizontal plate portion and the flange-like plate portions and bowed into the card receiving space and defining a pair of guiding recesses between the tabs.

10. The card connector as claimed in claim 9, wherein each of said tabs stamped from the metallic shell with thereof two opposite ends integrally connected to said metallic shell.

* * * * *